United States Patent [19]

Oberg

[11] Patent Number: 4,863,053

[45] Date of Patent: Sep. 5, 1989

[54] WASTE CONTAINER

[75] Inventor: Robert E. Oberg, South Sioux City, Nebr.

[73] Assignee: The Broyhill Mfg. Co., Inc., Dakota City, Nebr.

[21] Appl. No.: 215,355

[22] Filed: Jul. 5, 1988

[51] Int. Cl.[4] ..... B65B 21/02; B65F 1/00

[52] U.S. Cl. ..... 220/1 T; 414/407; 414/411

[58] Field of Search ..... 414/406, 407, 408, 409, 414/411; 220/1 T, 260, 262

[56] References Cited

U.S. PATENT DOCUMENTS

| | | | |
|---|---|---|---|
| 2,185,352 | 1/1940 | Pefers | 220/1 T |
| 2,953,265 | 9/1960 | Linde | 414/407 |
| 3,687,317 | 8/1972 | Gagel | 414/411 |
| 3,747,785 | 7/1973 | Dahlin | 414/406 |
| 4,113,120 | 9/1978 | Pickrell | 414/406 |
| 4,182,530 | 1/1980 | Hodge | 220/1 T |

FOREIGN PATENT DOCUMENTS

| | | | |
|---|---|---|---|
| 944032 | 12/1963 | United Kingdom | 414/406 |

*Primary Examiner*—A. Michael Chambers

*Attorney, Agent, or Firm*—Zarley, McKee, Thomte, Voorhees & Sease

[57] ABSTRACT

A waste container comprising a cylindrical barrel having a lid hingedly secured thereto and which may be moved between open and closed positions. A latching mechanism is secured to the side wall of the barrel and securely latches the lid in its closed position until sufficient force is applied to a pressure pad located at the outside of the barrel.

10 Claims, 5 Drawing Sheets

WASTE CONTAINER

BACKGROUND OF THE INVENTION

This invention relates to a waste container and more particularly to a waste container having a lid hingedly secured to the upper end thereof which is locked in its closed position and which can only be opened when sufficient pressure is applied to a pressure pad positioned at the exterior of the barrel.

Waste containers are located at various locations throughout a city such as parks, beaches, etc. It is desirous to be able to retrieve bottles, cans, etc. from the waste in the waste containers for recycling purposes. However, even if a separate container is utilized for deposit of bottles, cans, etc., scavengers frequently open the container and remove the cans and bottles from the container.

It is therefore a principal object of the invention to provide a waste container which is designed to receive articles for recycling.

A further object of the invention is to provide a waste container having a lid mounted thereon with the lid having a small central opening provided therein so that bottles, cans, etc. may be inserted into the container through the opening.

Still another object of the invention is to provide a waste container having a lid hingedly secured thereto including a latching means which prevents the lid from being manually opened thereby deterring scavengers.

Still another object of the invention is to provide a waste container which is adapted for use with a Load-and-Pack Model 78 refuse collection machine.

A further object of the invention is to provide a waste container having a self-closing lid.

These and other objects will be apparent to those skilled in the art.

SUMMARY OF THE INVENTION

A waste container is provided which includes a cylindrical barrel having an open upper end and a lid hingedly secured thereto. The lid is hingedly secured to the barrel by means of a hinge strap and may be moved from an open to a closed position. In its closed position, a latching mechanism positively maintains the lid in its closed position. The lid can only be unlatched or opened when sufficient pressure is applied to a pressure pad located at the exterior of the barrel and which is operatively interconnected with the latching mechanism. Inasmuch as in excess of two hundred pounds of force is required to unlatch the latching mechanism, the lid cannot be opened thereby preventing the removal of recyclable items therein. The lid has a small central opening formed therein adapted to permit the insertion of articles for recycling such as cans, bottles, etc. A deflector is positioned beneath the central opening in the lid to discourage a person from reaching into the interior of the container.

DESCRIPTION OF THE PREFERRED EMBODIMENT

Figure 1:
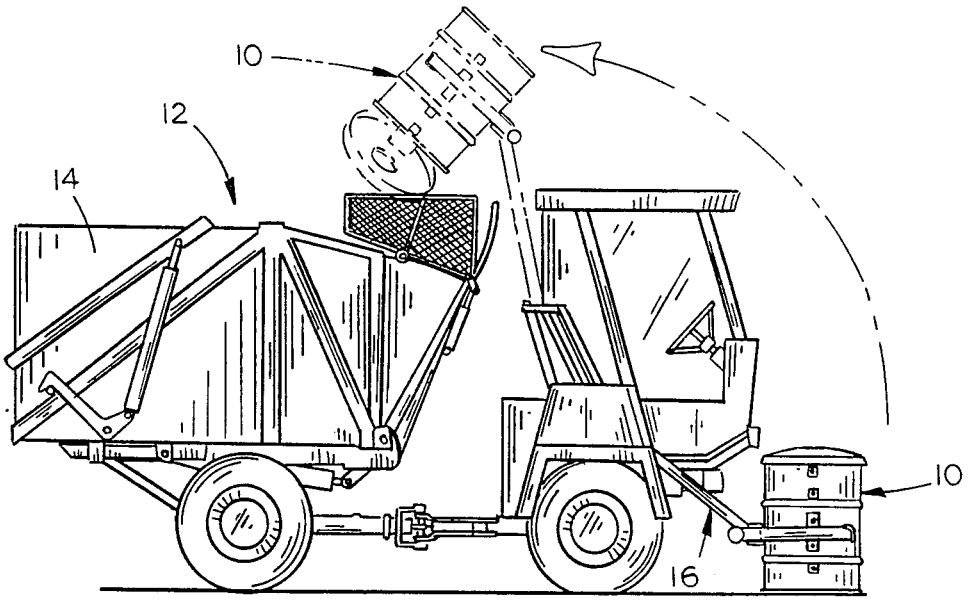
FIG. 1 is a side view illustrating a Load-and-Pack Model 78 refuse collection vehicle being used to dump the waste container of this invention.
Figure 2:
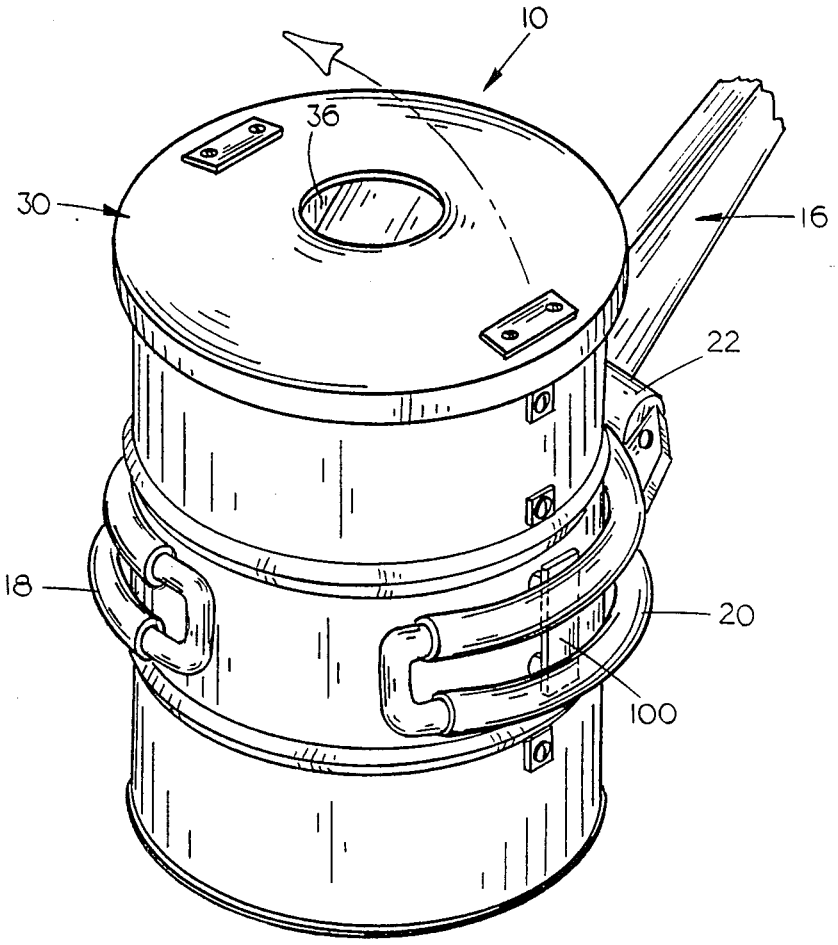
FIG. 2 is a perspective view of the waste container of this invention being gripped by the gripper arms of the Load-and-Pack machine.

The waste container of this invention is referred to generally by the reference numeral 10 while the reference numeral 12 refers to a Load-and-Pack Model 57 refuse collection machine such as described in U.S. Pat. No. 4,113,120. Machine 12 includes a refuse receptacle 14 which is adapted to receive the contents of the container 10 when the lift arm assembly 16 raises the container 10 from the position illustrated by solid lines in FIG. 1 to the position illustrated by broken lines in FIG. 1. Lift arm assembly 16 includes a pair of grip arms 18 and 20 which are pivotally mounted on the lift arm 16. A hydraulic cylinder 22 interconnects the inner ends of the grip arms 18 and 20 so that the container may be gripped and raised to the dumping position as illustrated.

Figure 5:
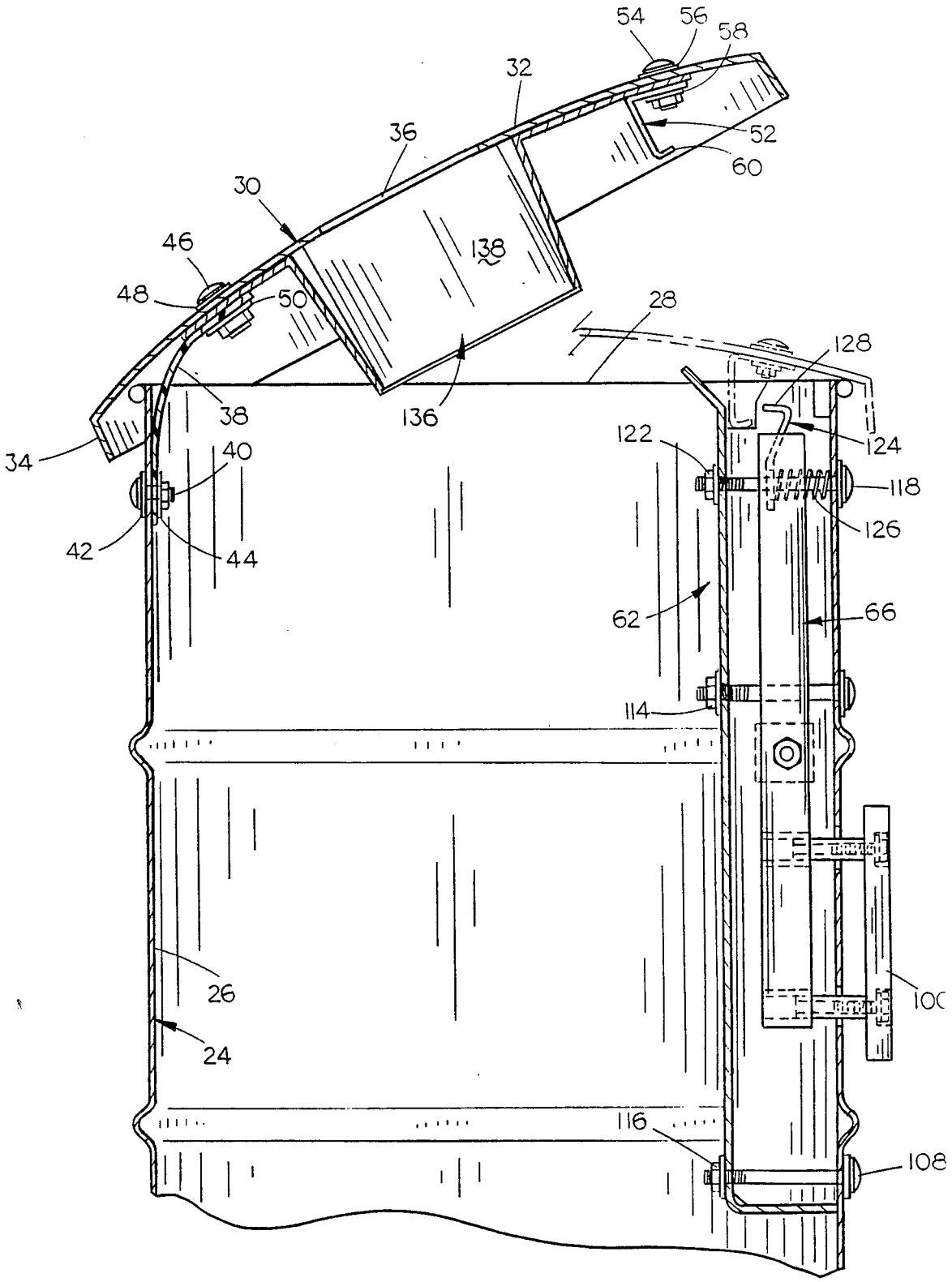
FIG. 5 is a sectional view similar to FIG. 4 except that the lid is being pivoted to its open position.

Container 10 comprises a cylindrical barrel 24 having a side wall portion 26 and an open upper end 28. Lid 30 is adapted to close the open upper end 28 and includes top portion 32 having an annular flange or lip 34 provided at the periphery thereof. Lid 30 is also provided with a small opening 36 formed therein adapted to permit the insertion of articles for recycling therethrough such as cans, bottles, etc. Lid 30 is hingedly secured to side wall 26 by means of a belt hinge 38. One end of hinge 38 is secured to side wall 26 by a pair of carriage bolts 40. Brace plates 42 and 44 are positioned at the exterior and interior surfaces of the side wall 26 as illustrated. A pair of carriage bolts 46 connect the other end of the hinge 38 to the lid 30 as seen in FIG. 5. Brace plates 48 and 50 are positioned at the exterior and interior surfaces of the lid 30 as seen in FIG. 5. Latch 52 is secured to lid 30 by a pair of carriage bolts 54 and brace plates 56 and 58. Latch 52 includes a horizontally extending lip portion 60.

Figure 3:
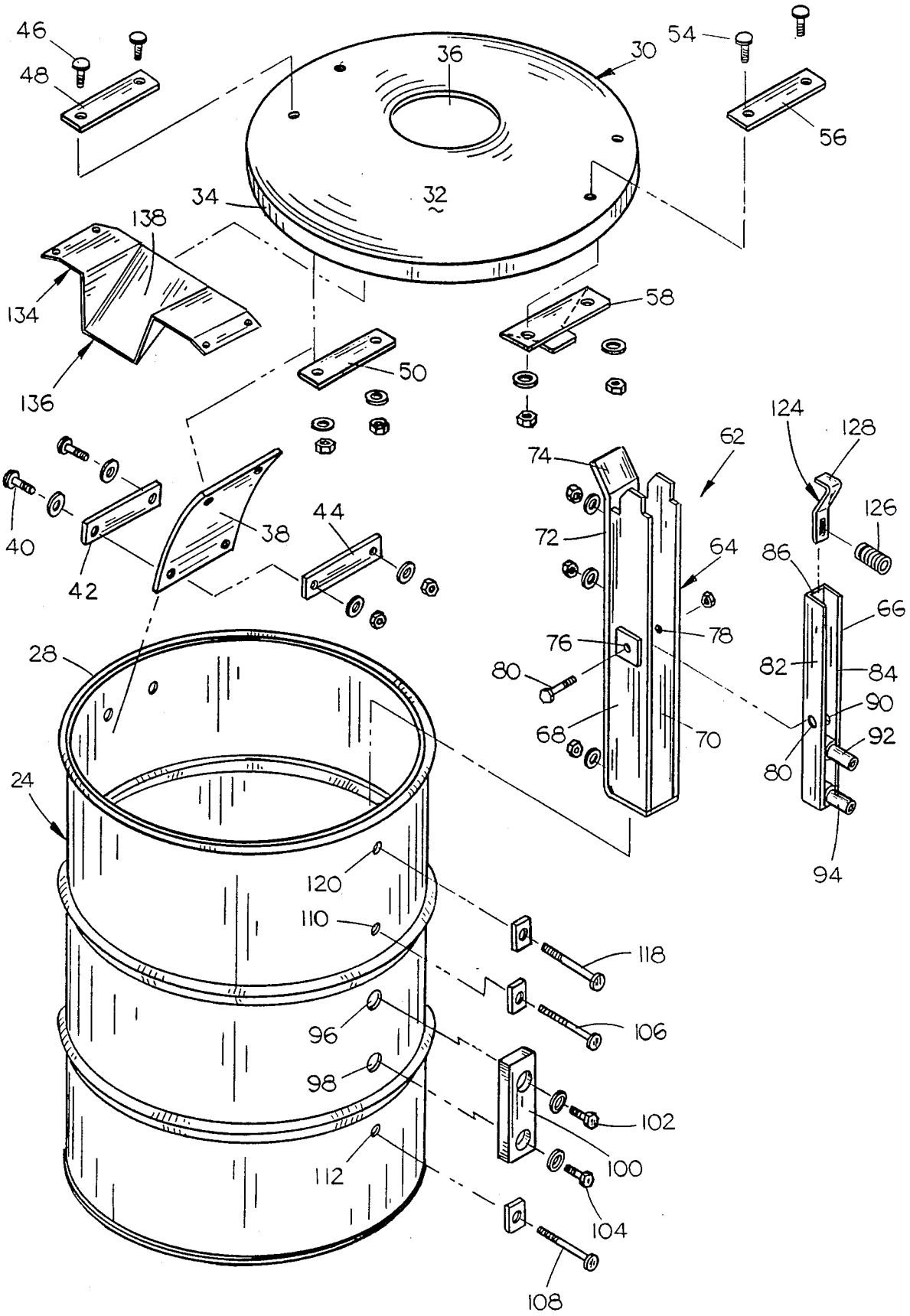
FIG. 3 is an exploded perspective view of the waste container of this invention.

The numeral 62 refers to a latching mechanism positioned at the interior of the barrel 24 generally including a pivot housing 64 and a pivot arm assembly 66. Housing 64 includes side 68 and 70 and inner wall 72. The upper end of inner wall 72 is provided with a latch ramp 74 which extends upwardly and inwardly therefrom as seen in FIGS. 3 and 5. A pair of openings 76 and 78 are formed in sides 68 and 70 respectively and are designed to have a pivot bolt 80 extending therethrough as will be described in more detail hereinafter.

Pivot arm 66 includes sides 82 and 84 and inner wall 86. Sides 82 and 84 are provided with openings 88 and 90 respectively which are adapted to receive the pivot bolt 80 extending therethrough to pivotally connect the pivot arm 66 to the housing 64. As seen in the drawings, pivot arm 66 is positioned between the side walls 68 and 70 of housing 64. Arm 66 has a pair of internally threaded sleeves 92 and 94 secured thereto by welding or the like which extend outwardly therefrom through opening 96 and 98 formed in barrel 24.

A rectangular pressure pad or release portion 100 is mounted on the outer ends of sleeves 92 and 94 and secured thereto by bolts 102 and 104 respectively. As seen in FIG. 5, pressure pad 100 is normally spaced outwardly from the exterior surface of the barrel 24. Bolts 106 and 108 extend through opening 110 and 112 formed in the side wall of barrel 24 and are secured to the pivot housing 64 by nuts 114 and 116. Inner wall 86 of pivot arm 66 is provided with a slot formed therein to enable the bolt 106 to extend therethrough.

Figure 4:
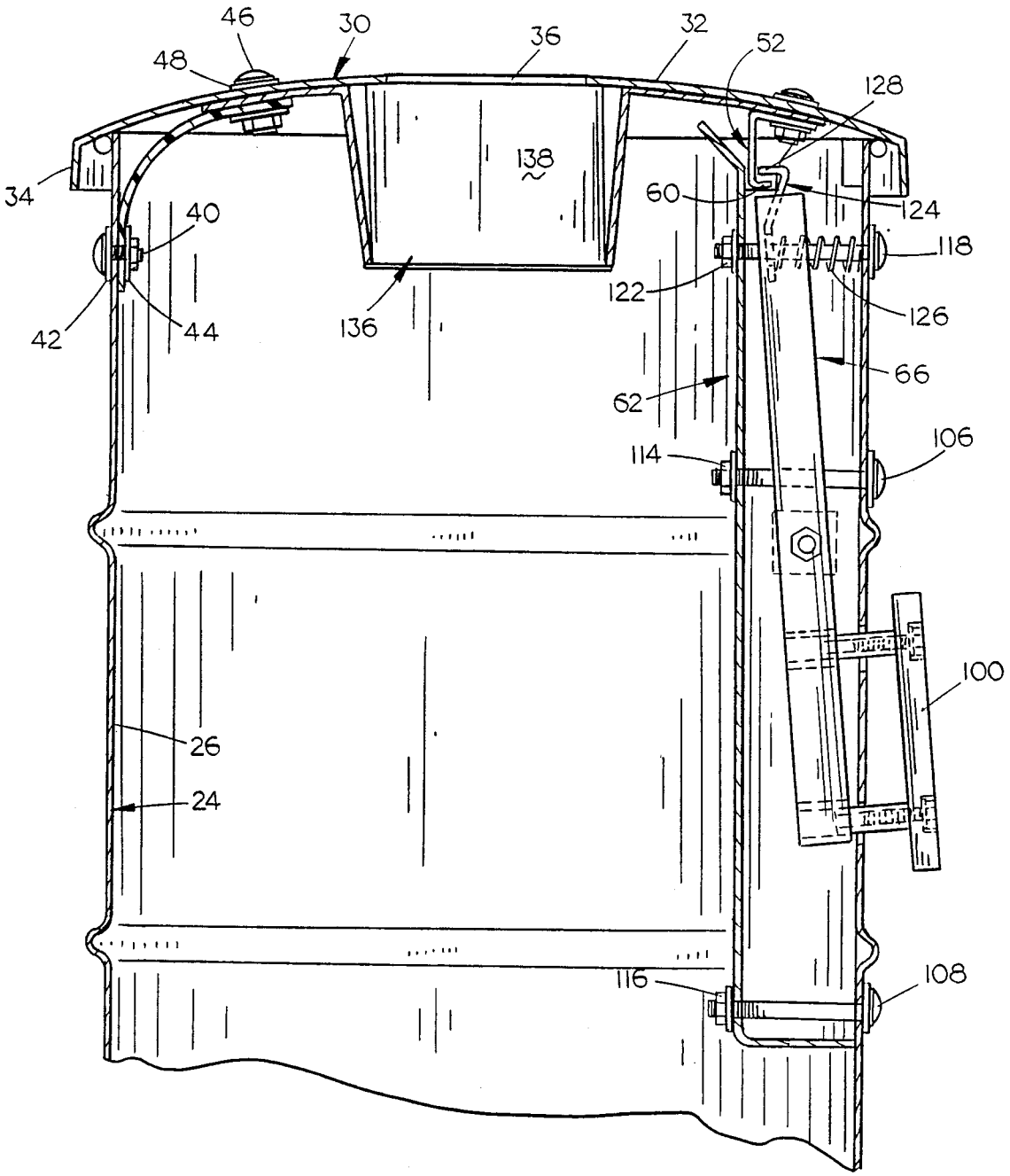
FIG. 4 is a partial vertical sectional view of the waste container of this invention with the lid in its closed and latched position.

Bolt 118 extends inwardly through opening 120 in barrel 24 and is secured to pivot housing 64 by nut 122. Bolt 118 extends through a slot formed in inner wall 86 of pivot arm 66. A hook and spring pressure plate 124 is mounted on bolt 118 between side walls 82 and 84 of pivot arm 66 and is held in that position by a two hundred to two hundred and fifty pounds compression spring 126. The upper end of plate 124 is provided with an inwardly extending hook portion 128 which is normally positioned above the portion 60 of latch 52 when the lid 30 is in its closed position as illustrated in FIG. 4 so that the lid cannot be opened.

Figure 6:
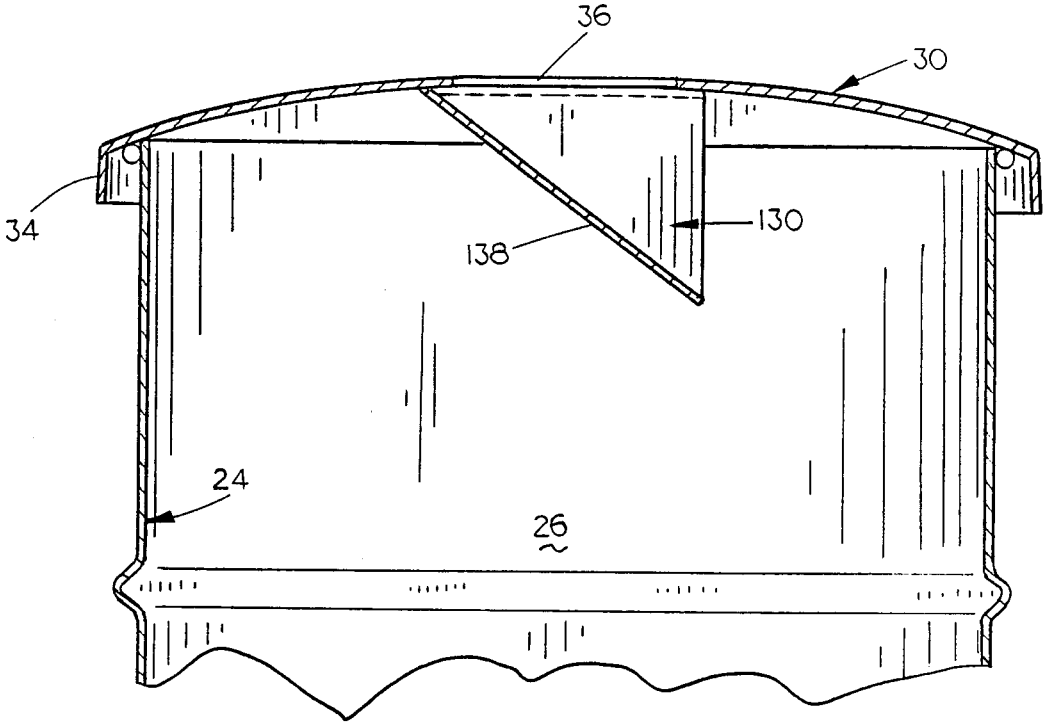
FIG. 6 is a sectional view illustrating the deflector which is positioned beneath the central opening in the lid.
Figure 7:
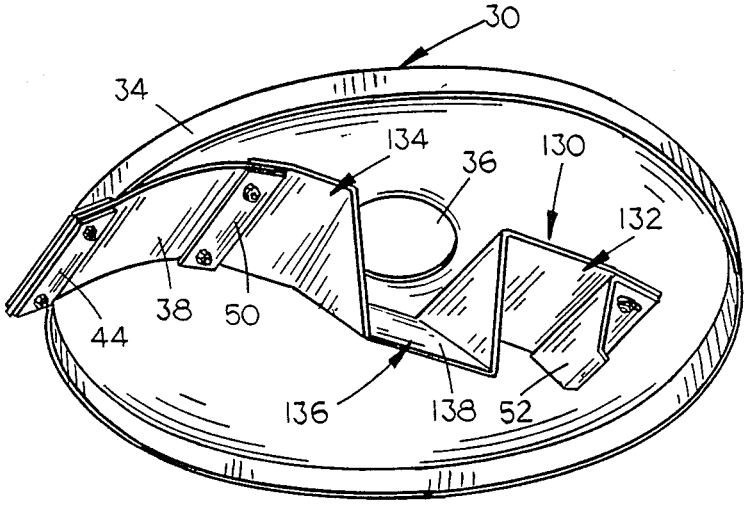
FIG. 7 is a bottom perspective view of the deflector which is positioned beneath the lid.

To discourage a person from reaching directly into the interior of the waste container, a deflector 130 is provided on the underside of the lid beneath the central opening 36. Deflector 130 includes a pair of end portions 132 and 134 having a deflector portion 136 positioned therebetween including an inclined wall 138 as best seen in FIG. 6. Deflector 130 is mounted on the underside of the lid 30 in the manner illustrated in FIG. 7.

In use, the lid 30 is normally in the closed position and the pivot arm 66 prevents the lid from being opened until sufficient force is applied to pressure pad 100 to overcome the strength of the two hundred to two hundred and fifty pound spring 126. Thus, access to the interior of the container is prevented thereby eliminating the possibility that scavengers will remove the items for recycling therefrom. When it is desired to empty the container, the machine 12 is maneuvered relative to the container 10 so that the grip arms 18 and 20 may grasp the container. The gripping action of the grip arms 18 and 20 causes the pressure pad 100 to be moved inwardly from the position of FIG. 4 to the position of FIG. 5 thereby causing the hook and spring plate 124 to be moved laterally outwardly relative to the portion 60 of latch 52. The container is then raised to the position illustrated by broken lines in FIG. 1. The weight of the lid causes the lid to move to the open position. The construction of the hinge 38 is such that the lid can only pivot open to approximately 75° thereby insuring that the lid will automatically move to its closed position when the container is placed on the ground after being dumped.

The deflector 130 prevents direct access to the interior of the container such as would be possible by someone inserting their arm through the central opening 36. With the deflector 130 in position, a person's reach is limited and confined to a small area.

Thus it can be seen that a novel waste container has been provided which accomplishes at least all of its stated objectives.

I claim:

1. A waste container, comprising, a cylindrical container means having a bottom, an upstanding side wall and an open upper end, a cover means hingedly secured to said side wall of said container and movable between a first position, wherein said cover means closes said open upper end of said container means, and a second open position, said cover means having an opening formed therein adapted to permit the insertion of waste therethrough, a latch member secured inside said container to said cover means opposite to the hinge connection between said cover means and said side wall, a movable latch means positioned inside said container and operatively secured thereto which is movable between a first normally closed position wherein it engages said latch member to maintain said cover in its closed position, to a second open position wherein it does not engage said latch member so that said cover means is free to move to its open position, yieldable resistance means operatively secured to said latch means for yieldably maintaining said latch means in its said first closed position, an actuator means operatively secured to said latch means for moving said latch means from its said first closed position to its said second open position, said actuator means including a release portion which is positioned exteriorly of said container and which must be moved relative to said container against the resiliency of said yieldable resistance means before said latch means will disengage from said latch member, said actuator means, except for said release portion, being positioned within said container.

2. The apparatus of claim 1 wherein said yieldable resistance means has a magnitude which is greater than that which could be normally manually applied by a person attempting to gain access to the interior of said container.

3. The apparatus of claim 2 wherein a refuse deflector means is positioned below said opening in said cover means.

4. The apparatus of claim 1 wherein a flat, flexible strap hingedly connects said cover means to said container means.

5. The apparatus of claim 4 wherein said strap is secured to the underside of said cover means and the inside of said side wall to limit the hinge movement of said cover means to approximately 75–80 degrees with respect to said cover means.

6. The apparatus of claim 1 wherein said release portion comprises a movable plate means.

7. The apparatus of claim 6 wherein said actuator means includes an elongated arm means having upper and lower ends, said latch means being mounted on the upper end of said arm means, said arm means being operatively pivotally secured, intermediate its ends, to said container means, said plate means being operatively secured to said lower end of said arm means, said plate means being mounted for movement radially towards and away from the sidewall of said container, said yieldable resistance means being in operative engagement with the upper end of said arm means.

8. The apparatus of claim 1 wherein a guide means is provided for guiding said latch member into latching engagement with said latch means as said cover means moves to its said closed position.

9. The apparatus of claim 8 wherein an elongated, vertically disposed pivot arm housing is secured to the interior surface of said side wall and adapted to protect said pivot arm from the contents of the container, said pivot arm being pivotally secured to said housing, said guide means being provided on the upper end of said housing.

10. In combination:

a refuse collection machine of the type having a lift arm assembly with a pair of grip arms pivotally mounted on a lift arm, the grip arms being disposed to pivot within the same general plane, and having powered means for pivoting said grip arms between a gripping position, biased towards one another, and a release position, biased away from one another; and a waste container adapted to be lifted and emptied by said refuse collection machine, comprising;

a cylindrical container means having a bottom, an upstanding side wall and an open upper end, a cover means hingedly secured to said side wall of said container and movable between a first position, wherein said cover means closes said open upper end of said container means, and a second open position, said cover means having an opening formed therein adapted to permit the insertion of waste therethrough, a latch member secured inside said container to said cover means opposite to the hinge connection between said cover means and said side wall, a movable latch means positioned inside said container and operatively secured thereto which is movable between a first normally closed position wherein it engages said latch member to maintain said cover means in its closed position, to a second open position wherein it does not engage said latch member so that said cover means is free to move to its open position, yieldable resistance means operatively secured to said latch means for yieldably maintaining said latch means in its said first closed position, an actuator means operatively secured to said latch means for moving said latch means from its said first closed position to its said second open position, said actuator means including a release portion which is positioned exteriorly of said container and which must be moved relative to said container against the resiliency of said yieldable resistance means before said latch means will disengage from said latch member, said actuator means, except for said release portion, being positioned within said container, said release portion comprising a movable plate means, said actuator means adapted to be actuated by the gripping action of said refuse collection machine gripping arms, and including:

an elongated arm means having upper and lower ends, said latch means being mounted on the upper end of said arm means, said arm means being operatively pivotally secured, intermediate its ends, to said container, said plate means being operatively secured to the lower end of said arm means and mounted for movement radially towards and away from the sidewall of said container, responsive to the gripping action of said refuse collection machine gripping arms, at least one connection rod means slidably disposed through an aperture in said sidewall, connecting said exteriorly mounted plate means to said interiorly mounted are means, yieldable resistance means being in operative engagement with the upper end of said arm means.

* * * * *